US005676361A

United States Patent [19]

Garbe

[11] Patent Number: 5,676,361

[45] Date of Patent: Oct. 14, 1997

[54] PAPER TRAY FOR AN AUTOMATIC SHEET FEEDER

[75] Inventor: Siegfried Garbe, Stuttgart, Germany

[73] Assignee: Eastman Kodak Company, Rochester, N.Y.

[21] Appl. No.: 631,206

[22] Filed: Apr. 12, 1996

[30] Foreign Application Priority Data

Apr. 15, 1995 [DE] Germany ..... 195 14 238.1

[51] Int. Cl.[6] ..... B65H 5/22

[52] U.S. Cl. ..... 271/3.04; 271/3.05; 271/207

[58] Field of Search ..... 271/3.04, 3.05, 271/207, 224

[56] References Cited

U.S. PATENT DOCUMENTS 4,433,836 2/1984 Kulpa et al. ..... 271/3.04

4,737,820 4/1988 Murray ..... 271/3.05

5,064,188 11/1991 Nagao et al. ..... 271/301

FOREIGN PATENT DOCUMENTS 0125562 7/1983 Japan ..... 271/207

*Primary Examiner*—H. Grant Skaggs

*Attorney, Agent, or Firm*—Lawrence P. Kessler

[57] ABSTRACT

The paper tray for an automatic sheet feeder has a tray base (2) to which is attached a lower paper alignment face (4) having a sheet ejection slot (6). An upper paper striking face (8) is located opposite the lower paper alignment face, in the vicinity of which is a set-count finger (10). The upper paper striking face (8) in the form of a striking block (9) which increases in thickness from the tray base (2) upwards is shaped in such a way that the documents returned to the paper tray can be relied upon to come to rest on top of the set-count finger (10).

3 Claims, 2 Drawing Sheets

PAPER TRAY FOR AN AUTOMATIC SHEET FEEDER

BACKGROUND OF THE INVENTION

The invention relates to a paper tray for an automatic sheet feeder having a tray base, a lower paper alignment face in which there is a sheet ejection slot, an upper paper striking face opposite the lower paper alignment face and a set-count finger in the vicinity of the lower paper alignment face.

Automatic sheet feeders simplify the process of copying documents on photocopiers. The documents to be copied are placed in the automatic sheet feeder and the number of copies required is entered on the control panel of the copier. When the copying process starts, the document at the bottom of the pile is taken first. When the last (top) document has been copied, the documents for a copying job have been copied once each. For the purposes of monitoring and control, a set-count finger rests on the top of the document stack before copying starts. The copied documents are returned to the paper tray by the feeder mechanism ready for the next copying pass. The documents have to be placed in the paper tray in such a way that they come to rest on top of the set-count finger.

The U.S. Pat. No. 5,064,188 describes an automatic sheet feeder apparatus. That apparatus involves a fast document tray located in the central area of the frame. That document tray has inside it a means of alignment or a concave alignment face. The leading edge of a document arriving in the tray strikes the concave alignment face and then comes to rest at the position required in the fast document tray. The alignment face concerned can, however, not always guarantee that a sheet arriving in the tray will not slip underneath the set-count finger, thereby resulting in incorrect positioning of the set-count finger. Such an eventuality would also have the undesirable effect of altering the order in which the documents of a copying job were copied.

SUMMARY OF THE INVENTION

The purpose of the present invention is to create a paper tray which reliably guarantees stacking of the incoming documents on top of the set-count finger.

The object of the present invention is achieved in that the upper paper striking face of the tray takes the form of a wedge-shaped block whose thickness increases from the base of the tray upwards and towards the set-count finger.

The advantage of the apparatus according to the invention is that the striking block attached to the upper paper striking face prevents a document returned to the tray from slipping under the set-count finger. It also ensures, virtually regardless of the parameters such as paper weight, paper size, dampness, direction of the paper fibers, angle of exit through the ejection slot, speed of exit or air pressure acting against the sheet as it comes to rest, a reliable positioning of the sheet on top of the set-count finger.

Other advantageous embodiments of the invention are described in the dependent claims.

The subject of the invention is described below with reference to the embodiment illustrated in the drawings.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
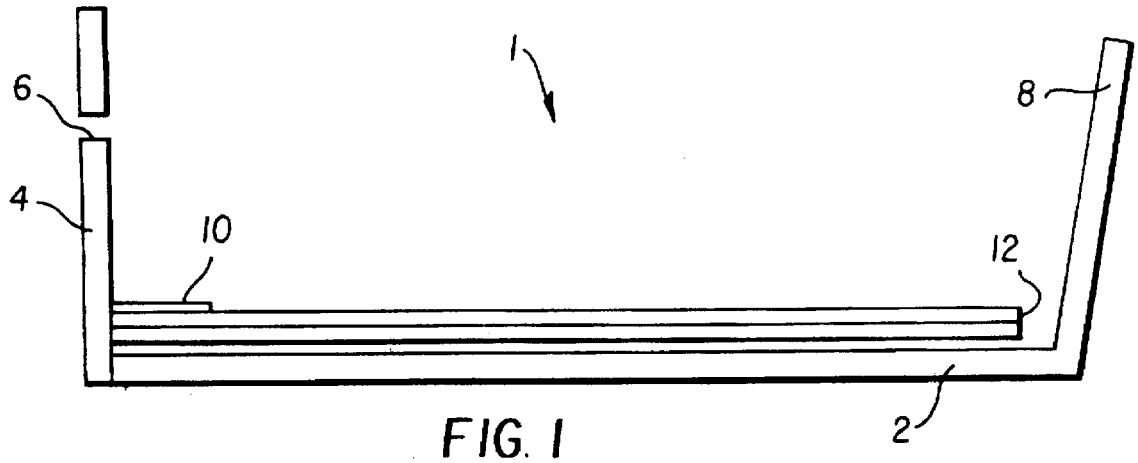
FIG. 1 (prior art)
FIG. 1 is a schematic diagram of an automatic sheet feeder according to the state of the art.

The paper tray of an automatic sheet feeder is shown in FIG. 1. That sheet feeder consists of a paper tray base 2 and a lower paper alignment face 4 more or less perpendicular to the paper tray base. Opposite the lower paper alignment face 4 is the upper paper striking face 8. The sides of the paper tray have been omitted from the drawing for the sake of clarity. The lower paper alignment face 4 has a sheet ejection slot 6 through which the documents are returned to the paper tray after being copied. Inside the paper tray there is also a movable set-count finger 10 in the vicinity of the lower paper alignment face 4. The set-count finger 10 always rests on top of the document at the top of the document pile 12 in the paper tray. The copier works through document pile 12 from the bottom upwards, i.e. the document lying directly on the paper tray base 2 is copied first and the topmost document of the document pile 12 is always the last to be copied in any one pass. The movable set-count finger 10 always marks the position of the top document. The copied documents returned to the paper tray after being copied must be placed on top of the set-count finger so that during the copying process of a document pile, a clear distinction between copied and uncopied documents is possible.

Figure 2:
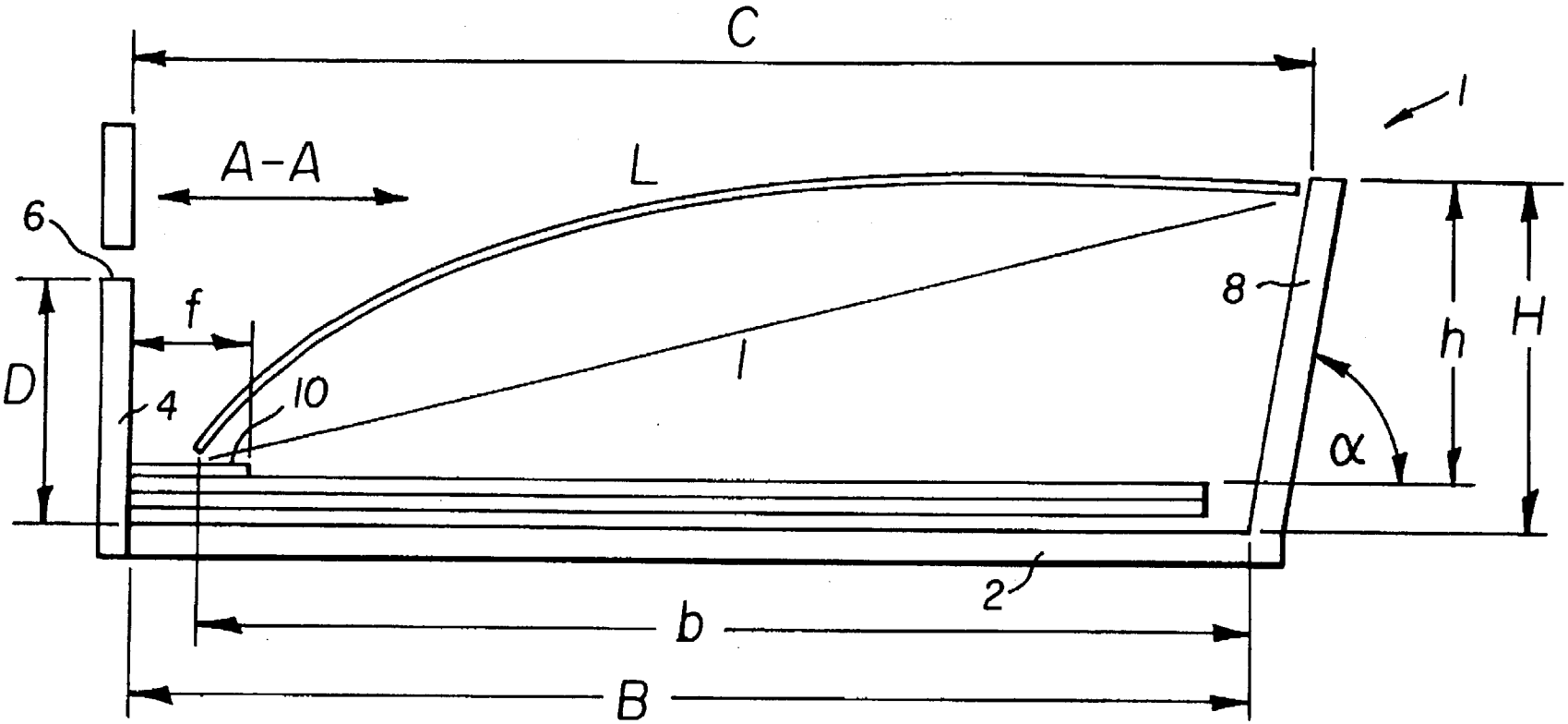
FIG. 2 is a schematic diagram similar to FIG. 1 with the addition of the dimensions of the automatic sheet feeder.

FIG. 2 shows the model of an automatic sheet feeder 1 as per FIG. 1 with the addition of the geometrical dimensions of the individual components of the paper tray necessary for a mathematical description of the automatic sheet feeder 1. For the sake of clarity, the reference numbers have been omitted. The total effective length of the paper tray base 2 for the purposes of stacking documents is the dimension B. The sheet ejection slot 6 is located at a height D above the paper tray base 2 in the lower paper alignment face 4. The upper paper striking face 8 is set an angle a to the plane formed by the paper tray base 2. Thus the distance C from the top edge of the lower paper alignment face to the top edge of the upper paper striking face is greater than B. The perpendicular distance from the paper tray base 2 to the top edge of the upper paper striking face 8 is the dimension H. The distance from the top of the document pile 12 to the top edge of the upper paper striking face is the dimension h. The dimension f represents the length of the set-count finger. The length of the document, which is returned to the paper tray through the ejection slot 6 by a means of conveyance which is not illustrated, is the dimension L. The direction of travel of the sheet is represented on FIG. 2 by a double-headed arrow A—A. The length of the set-count finger is f. The distance from the point of contact of the document with the set-count finger 10 and the point at which it strikes the upper paper striking face is represented by the dimension 1.

The following are common dimensions for paper trays:

B=215.0 mm

C=232.0 mm

L=210.0 mm

D=50.0 mm f=20.0 mm d=0.12 mm (sheet/document thickness)

$\alpha$=70°

Figure 3:
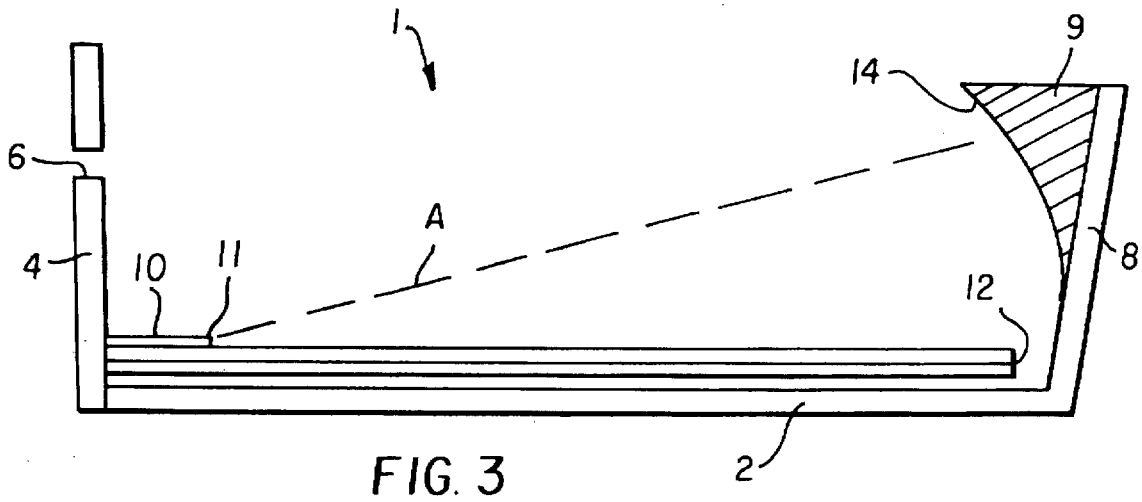
FIG. 3 is a cross-section of the automatic sheet feeder according to the invention.

FIG. 3 shows the apparatus as per FIG. 1 in which the upper paper striking face has been modified in accordance with the present invention. A striking block has been fitted which lends the upper paper striking face a concave surface 14. That concave surface is shaped in such a way that the thickness of the striking block 9 increases from the base of the tray 2 upwards and towards the set-count finger. The striking block 9 having the concave surface can be constructed as an integral part of the upper paper striking face or can take the form of an attachment (not illustrated) to the upper paper striking face 8.

The geometrical shape of the contour (of the concave surface) is described by means of the following equation:

$$L=\frac{1}{2}\sqrt[2]{4L_s^2+L_sa^2}+\frac{1}{8}a21n\left(4\sqrt[2]{4L_s^2+L_sa^2+8L_s+a^2}\right)$$

where a is the deformation factor of the sheet. The deformation of a sheet ejected through the ejection slot and striking the upper paper striking face depends on a number of parameters. Those parameters are paper weight, paper size, dampness, direction of the fibers in the sheet, the angle of exit from the ejection slot, the speed of exit and the air pressure acting against the sheet as it comes to rest. The mathematical description of this deformation can be determined with the aid of a high speed camera.

$L_s$ indicates the position of the point at which a sheet exiting through the ejection slot 6 first contacts the document pile on the paper tray base 2. It should be noted in this connection that $L_s$ is always greater than the difference L-f. Provided that condition is met, it can be reliably assumed that the sheet will land on top of the set-count finger 10.

The concave surface 14 of the striking face has been chosen so as to allow the sheet to be deformed to a greater extent without the risk of its slipping underneath the set-count finger. This significantly reduces the likelihood of such an eventuality. In addition, the perpendicular distance A to the front edge 11 of the set-count finger 10 from any line on the concave surface of the striking face 8 running parallel to the tray base 2 and at right angles to the direction of travel of the sheet A—A is less than the length of the sheet L.

The invention has been described in detail with particular reference to preferred embodiment thereof, but it will be understood that variations and modifications can be effected within the spirit and scope of the invention as set forth in the claims.

What is claimed is:

1. Paper tray of an automatic sheet feeder having a tray base (2), a lower paper alignment face (4) in which there is a sheet ejection slot (6), an upper paper striking face (8) opposite the lower paper alignment face, and a set-count finger (10) in the vicinity of the lower paper alignment face (4), characterized in that the upper paper striking face (8) takes the form of a striking block (9) the thickness of which increases from the base (2) of the tray upwards and towards the set-count finger (10) so as to define a concave surface where the perpendicular distance (A) to the front edge (11) of the set-count finger (10) from any line on the concave surface of the striking face (8) running parallel to the tray base (2) and at right angles to the direction of travel of the sheet (A—A) is less than the length of the sheet (L).

2. Paper tray in accordance with claim 1 characterized in that the perpendicular distance (A) from any line on the concave surface of the striking face (8) running parallel to the tray base (2) and at right angles to the direction of travel of the sheet (A—A) to a similar parallel line on the surface of the set-count finger (10) is always the same.

3. Sheet feeder in accordance with claim 1 characterized in that the concave surface of said striking face (8), formed by the striking block (9), is described by the following equation:

$$L=\frac{1}{2}\sqrt[2]{4L_s^2+L_sa^2}+\frac{1}{8}a21n\left(4\sqrt[2]{4L_s^2+L_sa^2+8L_s+a^2}\right)$$

where:

L is the length of a sheet;

$L_s$ indicates the position of the point at which a sheet first contacts a document pile on the tray base; and a is the deformation factor of the sheet.

* * * * *